United States Patent [19]

Holland et al.

[11] 3,962,583

[45] June 8, 1976

[54] X-RAY TUBE FOCUSING MEANS

[75] Inventors: William P. Holland, West Redding; Capleton I. Swanson, Bridgeport, both of Conn.

[73] Assignee: The Machlett Laboratories, Incorporated, Stamford, Conn.

[22] Filed: Dec. 30, 1974

[21] Appl. No.: 537,225

[52] U.S. Cl. ..... 250/402; 250/404; 250/405; 313/57

[51] Int. Cl.[2] ..... H05G 1/30; H01J 35/14

[58] Field of Search ..... 250/401, 402, 403, 404, 250/405; 313/57

[56] References Cited

UNITED STATES PATENTS

| | | | |
|---|---|---|---|
| 3,192,425 | 6/1965 | Foster | 313/57 |
| 3,732,426 | 5/1973 | Shimizer | 313/57 |
| 3,743,836 | 7/1973 | Holland | 250/405 |

*Primary Examiner*—Craig E. Church
*Attorney, Agent, or Firm*—John T. Meaney; Joseph D. Pannone; Harold A. Murphy

[57] ABSTRACT

An X-ray tube comprising a tubular envelope having therein a filamentary cathode operatively disposed for directing a beam of electrons toward a spaced anode target, the cathode being insulatingly supported in a slotted open end of a focusing cup and extending longitudinally between an insulated pair of spaced conductive ears, and including means for applying respective electrical potentials to the anode, cathode, focusing cup, and each of the conductive ears.

8 Claims, 3 Drawing Figures

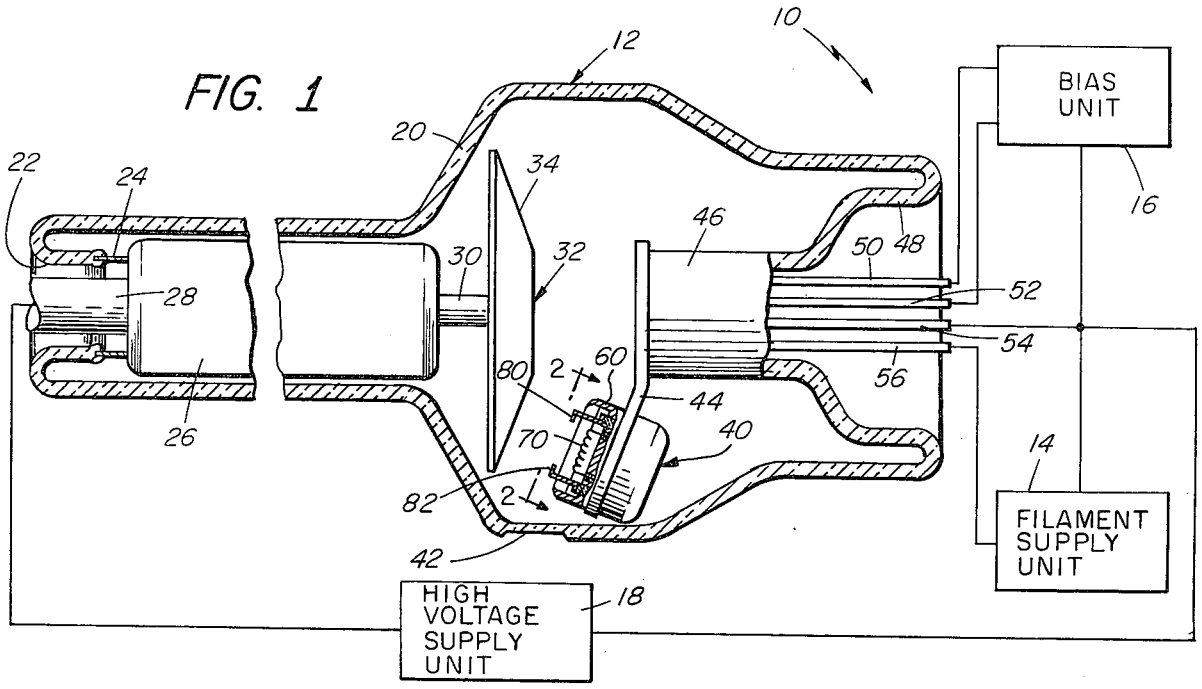
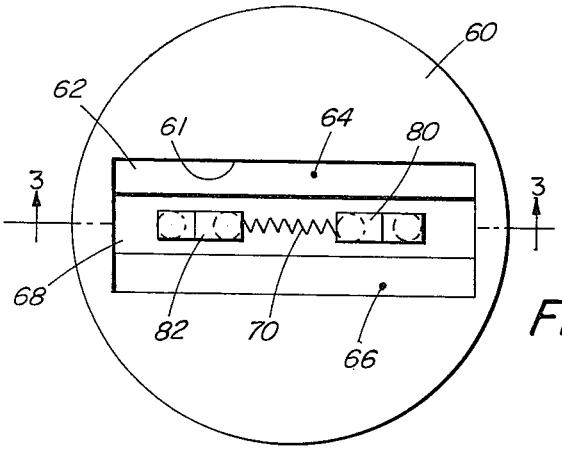
FIG. 2
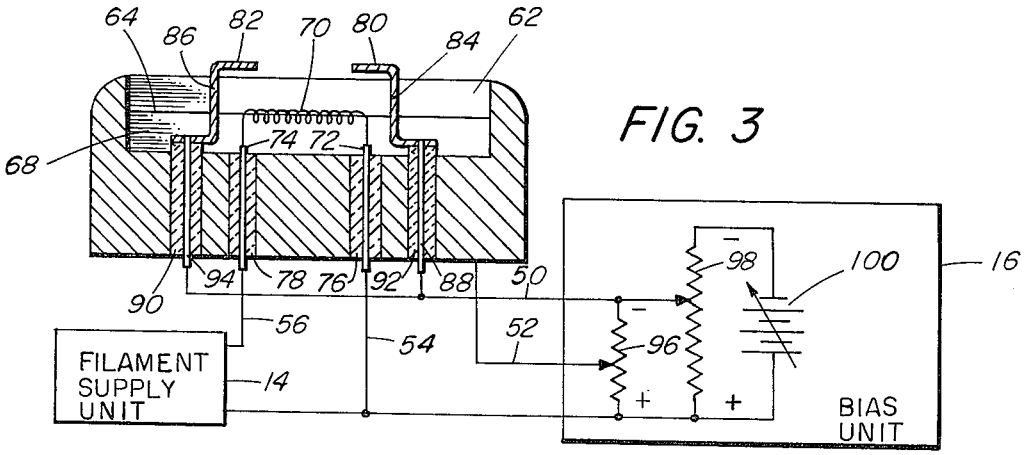
FIG. 3

X-RAY TUBE FOCUSING MEANS

BACKGROUND OF THE INVENTION

This invention relates generally to X-ray apparatus and is concerned more particularly with an X-ray tube having adjustable focusing means.

Generally, in an X-ray tube, of the line focusing type, electrons emitted from a filamentary cathode are beamed toward a spaced anode target surface, which is sloped in the direction of a radially aligned, X-ray transparent window in the tube envelope. The electron beam impinges on an aligned area of the sloped target surface, commonly called the "actual focal spot area," which has a configuration corresponding to the incident cross-section of the beam. Thus, the beamed electrons bombarding the actual focal spot area of the target surface generate a useful X-ray beam which passes through the radially aligned, X-ray transparent window. Accordingly, from the direction of the window, the X-ray beam appears to be emanating from a radial projection of the actual focal spot area on the sloped target surface, commonly called the "projected focal spot."

In order to provide the high resolution required for visualizing fine detailed structure encountered in radiography, it is necessary that the projected focal spot have sufficient resolving power and X-ray intensity. Consequently, in conventional X-ray tubes of the line focusing type, the electron emitting cathode generally is disposed in an equipotential cup having a slotted open end from which electrons are directed toward the sloped target surface of the anode. Electrons emerging from the cup are electrostatically accelerated toward the target surface in a flat beam having a generally rectangular cross-section. The resulting rectangular, actual focal spot area extends longitudinally with the slope of the target surface and, consequently, is disposed at a corresponding angle with the radially aligned, X-ray transparent window. Accordingly, from the direction of the window, a radial projection of the rectangular, actual focal spot area of the sloped target surface forms a small square, projected focal spot from which the X-ray beam appears to originate. Thus, the small square, projected focal spot can be made comparable to a point source of X-radiation by reducing it in size as much as possible. However, such reduction in size is limited by the diagonally disposed corners of the square configuration.

In U.S. Pat. No. 3,743,836 granted to W. P. Holland et. al., and assigned to the assignee of this invention, there is disclosed an X-ray tube of the line focusing type which provides a small circular, projected focal spot having a centralized peak region of maximum X-ray intensity, in the manner of a Gaussian distribution of X-ray energy. The electron emitting cathode is insulatingly supported within a cathode focusing cup which is maintained at a negative potential with respect to the cathode. Electrons emerging from the cup are electrostatically accelerated toward the sloped target surface in a beam having an elliptical cross section. The resulting elliptical, actual focal spot area extends longitudinally with the slope of the target surface and, consequently, is disposed at a corresponding angle with the radially aligned, X-ray transparent window. Accordingly, from the direction of the window, a radial projection of the elliptical, actual focal spot area of the sloped target surface forms a small circular, projected focal spot from which the X-ray beam appears to originate. Thus, the small circular, projected focal spot will more closely approximate a point source of X-radiation the more it is reduced in size.

In both of the described line focusing types of X-ray tubes, the size of the projected focal spot is dependent on the size of the associated actual focal spot area, which may vary with changes in cathode current and anode-cathode voltage. The cathode current, for example, may be adjusted during operation of the tube to obtain greater electron emission for increasing the intensity of the X-ray beam. However, the resulting greater density of electrons in the beam impinging on the actual focal spot area of the target surface produces a proportionate increase in space charge repulsion which causes the electron beam to spread. Consequently, the size of the actual focal spot area expands conformingly and produces an associated increase in the size of the projected focal spot. Thus, the approximation of the projected focal spot to a point source of X-radiation decreases; and the resolution provided by the resulting X-ray beam deteriorates accordingly.

Therefore, it is advantageous to provide an X-ray tube of the line focusing type with means for adjusting the size of the effective focal spot independently of changes in cathode current and anode-cathode voltage.

SUMMARY OF THE INVENTION

Accordingly, this invention provides an X-ray tube having means for separately controlling the length and width dimensions of the projected focal spot independently of cathode current and anode-cathode voltage. The X-ray tube comprises a tubular envelope having therein a filamentary cathode operatively disposed to direct a beam of electrons toward a target surface of a spaced anode electrode, and insulatingly supported in a slotted opening of a cathode focusing cup. Extending in spaced relationship between respective end portions of the cathode and the target surface is a pair of spaced conductive tabs or ears which are insulatingly supported adjacent respective ends of the slotted opening in the focusing cup. Terminal means are electrically connected to the anode, cathode, focusing cup and each of the conductive ears for applying thereto respective potentials which focus electrons emitted from the cathode onto a desired actual focal spot area of the anode target thereby adjusting the size of the associated effective focal spot.

In operation, an adjustable current source is electrically connected across the filamentary cathode for controllably heating the cathode to a desired electron emitting temperature. A polarized voltage source is electrically connected between the cathode and the anode target surface for electrostatically attracting electrons emitted from the cathode toward the anode target surface in a beam. A first biasing means is electrically connected between the cathode and the focusing cup, and a second biasing means is electrically connected between the cathode and each of the conductive ears, for biasing the focusing cup and each of the conductive ears at respective potentials with respect to the cathode. The bias potential applied to the focusing cup generally has maximum effect on portions of the beam adjacent the longitudinal edges of the slotted opening in the cup, and usually has very little effect on portions of the beam adjacent the transverse ends of the slotted opening. However, the ears disposed adjacent respective ends of the slotted opening have applied thereto a bias potential, preferably two to ten times greater than the potential applied to the focusing cup, which has the desired electrostatic focusing effect on adjacent portions of the beam.

Thus, the longitudinal edges of the slotted opening in the focusing cup, and the pair of spaced conductive ears insulatingly disposed adjacent respective ends of the slotted opening constitute a beam focusing aperture through which electrons emitted from the cathode are beamed toward the anode target surface. Respective pairs of opposing sides of the aperture are separately controllable by means external of the tube to have the desired electrostatic focusing effect on adjacent portions of the electron beam. Accordingly, one dimension of the actual focal spot area of the target surface may be varied by adjusting the biasing potential applied to the focusing cup. The orthogonal dimension of the actual focal spot area may be varied by adjusting the respective biasing potentials applied to each of the conductive ears.

BRIEF DESCRIPTION OF THE DRAWING

For a better understanding of this invention, reference is made in the following more detailed description to the accompanying drawing wherein:

FIG. 1 is an axial view, partly in section, of an X-ray tube and apparatus embodying the invention;

FIG. 2 is an enlarged plan view taken along the line 2—2 in FIG. 1 and looking in the direction of the arrows; and FIG. 3 is an axial sectional view taken along the line 3—3 in FIG. 2 and looking in the direction of the arrows.

DESCRIPTION OF THE PREFERRED EMBODIMENT

Referring more particularly to the drawing wherein like characters of reference designate like parts, there is shown in FIG. 1 an X-ray generating apparatus 10 including an X-ray tube 12 which is electrically connected to an adjustable filament supply unit 14, an adjustable bias unit 16, and an adjustable high voltage supply unit 18.

X-ray tube 12 comprises a generally tubular envelope 20 which may be made of dielectric material, such as lead-free glass, for example. One end of envelope 20 is provided with a reentrant portion 22 which is peripherally sealed to one end of a metal collar 24. The other end of collar 24 is hermetically attached, in a well-known manner, to one end of a conventional anode rotor 26 which is made of conductive material, such as copper, for example. A stem 28 of rotor 26 extends externally of the envelope 20 and provides terminal means for electrically connecting the rotor 26 to a positive terminal of the adjustable high voltage supply unit.

Within the envelope 20, a conductive shaft 30 made of refractory material, such as molybdenum, for example, extends longitudinally from the internal end of rotor 26 and is in electrical communication therewith. Fixedly attached to the distal end portion of shaft 30 is a perpendicularly disposed anode disk 32 which is rotated by the shaft 30 in a well-known manner. The inner end of disk 32 has a frusto-conical configuration for providing a sloped annular target surface 34 adjacent its outer periphery. The target surface 34 is made of a material, such as tungsten, for example which readily emits X-rays when bombarded by high energy electrons. However, other portions of anode disk 32 may be made of suitable conductive material, such as molybdenum, for example.

Although anode disk 32 is rotatable, a portion of the target surface 34 is continuously positioned in spaced opposing relationship with a cathode head 40 and is sloped toward a radially aligned, X-ray transparent window 42 in the envelope 20. The cathode head 40 is fixedly supported on a suitably angled end portion of a hollow arm 44 which has an opposing end portion hermetically attached to one end of an axially disposed support cylinder 46. The other end of support cylinder 46 is circumferentially sealed to a reentrant portion 48 of envelope 20, out of which hermetically extend electrical terminal lead members 50, 52, 54, and 56, respectively.

The terminal lead members 50 and 52 are electrically connected to respective output terminals of the adjustable biasing unit 16. Another output terminal of the biasing unit is connected electrically to the terminal lead member 54, in common, with an output terminal of the adjustable filament supply unit 14 and the negative output terminal of high voltage unit 18. The terminal lead member 56 of tube 12 is connected electrically to another respective output terminal of filament supply unit 14. Within envelope 20, the terminal lead members 50, 52, 54 and 56, respectively, extend through the hollow arm 44 and into the cathode head 40.

The cathode head 40 includes a cylindrical focusing cup 60 made of conductive material, such as nickel, for example, and having an end surface disposed in spaced opposing relationship with an arcuate portion of the sloped target surface 34. As shown more clearly in FIGS. 2 and 3, a slotted opening 61 of a rectangular cavity 62 diametrically disposed in the end surface of cup 60 extends radially with respect to the target surface 34. Cavity 62 terminates in a coextensive pair of spaced opposing steps, 64 and 66, respectively, which extend into a more narrow, second rectangular cavity 68. Axially disposed in the opening of cavity 68 and insulatingly spaced from the adjacent corners of steps 64 and 66, respectively, is a helically wound filament 70 which is made of suitable electron emitting material, such as tungsten, for example.

The filament 70 is insulatingly supported in the opening of cavity 68 by opposing end portions thereof being fixedly attached, as by welding, for example, to end portions of respective wires 72 and 74. The wires 72 and 74 are axially supported in respective bushings 76 and 78 which are made of dielectric material, such as ceramic, for example, and extend from an opposing closed end surface of cup 60 through the bottom of cavity 68. The opposing end portions of wires 72 and 74 protrude insulatingly from the other ends of dielectric bushings 76 and 78, respectively, and are electrically connected by conventional means to respective terminal lead members 54 and 56. Thus, the wires 72 and 74 provide conductive means for sending electrical current from the filament supply unit 14 through the filament 70 to heat it to a desired electron emitting temperature during operation of tube 12. Also, since the terminal lead member 54 is connected electrically to the negative terminal of high voltage supply unit 18, the wire 72 serves to maintain the filament 70 negative with respect to the anode disk 32. As a result, the electrons emitted from filament 70 are electrostatically drawn in a beam toward the aligned portion of the sloped target surface 34.

Protruding insulatingly between end portions of the filament 70 and the target surface 34 are respective focusing tabs or ears 80 and 82 made of conductive material, such as nickel, for example. Each of the ears, 80 and 82, respectively, is provided with a width dimension greater than the diameter of the helically wound filament 70 and a length dimension sufficient to expose only a desired length of the filament 70 to the target surface 34. The ears 80 and 82 may comprise bent end portions of respective thin metallic strips 84 and 86 having opposing bent end portions suitably attached to end surfaces of respective dielectric bushings 88 and 90 which protrude from the bottom of cavity 68. Thus, the respective intermediate portions of the strips 86 and 86 may be provided with respective length dimensions available for fixedly positioning the ears 80 and 82 in predetermined spaced relationship with the associated end portions of filament 70 and with the open end of focusing cup 60. For example, the ears 80 and 82 may be thus positioned in the plane of the slotted opening of cavity 62 or may protrude slightly out of the focusing cup 60.

The bushings 88 and 90, which may be made of ceramic material, for example, extend from the closed end surface of focusing cup 60 through the bottom of cavity 68 to provide dielectric circuit means for respective wires 92 and 94 which are axially disposed therein. Within the cavity 68, end portions of the wires 92 and 94 are electrically connected by suitable means to adjacent end portions of the metallic strips 84 and 86, respectively. The opposing end portions of the wires 92 and 94 protrude insulatingly from the other ends of bushings 88 and 90, respectively, and are electrically connected, in common, to the terminal lead member 50, which is electrically connected to one output terminal of the biasing unit 16. Also, within the cathode head 44 the focusing cup 60 is electrically connected by conventional means to the terminal lead member 52, which is electrically connected to another output terminal of biasing unit 16. Thus, since a third output terminal of adjustable biasing unit 16 is electrically connected to terminal lead member 54, the focusing cup 60 and the focusing ears 80 and 82, respectively, may be biased positively or negatively, as desired, with respect to the filamentary cathode 70.

The biasing voltage applied to focusing cup 60 has a substantial focusing effect between the longitudinal edges of the slotted opening 61, and a comparatively minor focusing effect between the transverse ends of opening 61. Consequently, when a beam of emitted electrons in passing through opening 61, the potential of focusing cup 60 is adjusted to control the beam dimension between the longitudinal edges of the opening. The orthogonally oriented dimension of the beam is controlled by adjusting the potentials of focusing ears 80 and 82, respectively, since this dimension of the beam extends between spaced ends of the respective focusing ears. It has been found that the required potential of focusing ears 80 and 82, respectively, is generally in the order of being two to ten times more negative than the preferred potential of focusing cup 60.

Accordingly, with the biasing unit 16, the terminal lead member 52, which is connected to focusing cup 60, is electrically connected to the movable tap of an adjustable resistive element 96. The element 96 has a terminal end connected in common with the terminal lead member 50, which is connected to the respective focusing ears 80 and 82, to the removable tap of another adjustable resistive element 98. The element 98 is connected across a suitable adjustable source 100 of polarized voltage such that the source 100 has a positive terminal connected in common with the positive terminals of the resistive elements 96 and 98, respectively, to the filament 70. As a result, the focusing cup 60 and the respective focusing ears 80 and 82 are biased negatively with respect to the filament 70, and the focusing ears are maintained at a greater negative potential than the focusing cup. For example, the movable taps of respective resistive elements 96 and 98 may be adjusted such that the focusing cup 60 is maintained at a negative 50 volts and the respective focusing arms 80 and 82 are maintained at a negative 400 volts with respect to the filament 70.

Accordingly, when the movable tap of resistive element 98 is adjusted to vary the beam dimension between spaced ends of the respective focusing ears 80 and 82, the beam dimension between the longitudinal edges of the slotted opening 61 is varied correspondingly. Also, the movable tap of resistive element 96 may be adjusted to vary the beam dimension between longitudinal edges of the opening 61 without varying the beam dimension between the spaced ends of respective focusing ears 80 and 82. Thus, one dimension of the resulting actual focal spot area and the corresponding dimension of the associated projected focal spot may be varied without affecting the respective orthogonal dimensions thereof.

Alternatively, the focusing cup 60 may be electrically connected to an independent source of biasing voltage such that the potentials of the focusing cup and the respective focusing ears 80 and 82 may be varied without affecting one another. Also, each of the focusing ears 80 and 82 may be electrically connected to respective independent sources of biasing voltage, so that the potential of one of the focusing ears may be varied without affecting the potential of the other focusing ear. Furthermore, longitudinal sides of the cavity 62 may be operatively coupled to one another in an electrically insulated manner, as by use of dielectric hardware, for example, so as to electrically connect the longitudinal sides of cavity 62 to respective independent sources of biasing voltage. In this manner, the respective potentials of the longitudinal edges of opening 62 may be varied independently of one another. Thus, the longitudinal edges of the opening 62 and the focusing ears 80 and 82 may form a beam focusing aperture the respective edges of which may be maintained at independently variable potentials.

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood therefore, that all matter shown and described herein is to be interpreted as illustrative and not in a limiting sense.

What we claim is:

1. X-ray generating apparatus including:

an X-ray tube envelope;

an anode having a target surface disposed within the envelope;

an elongated electron emitting filament spaced from the target surface within the envelope and disposed to direct a beam of electrons onto an elongated area of the target surface;

electron focusing means comprising a plurality of conductive members insulatingly supported in fixed positional relationship with one another adjacent the filament and having longitudinal and transverse portions with respect to the filament for defining in the path of the electron beam an elongated aperture having a length less than the length of the filament, one of the conductive members being a cathode focussing cup having an elongated opening wherein the filament is insulatingly disposed in the cup to direct the electron beam through the opening and other conductive members of the focussing means comprising a pair of spaced conductive strips insulatingly supported within the cup adjacent respective end portions of the filament; and electrical means for maintaining the anode, filament, and conductive members at different electrical potentials with respect to one another, and for maintaining at least one of the conductive members at a different electrical potential with respect to the other conductive members of the focusing means.

2. X-ray apparatus as set forth in claim 1 wherein the electrical means includes means for varying the potential of at least one of the conductive members independently of the other conductive members.

3. X-ray generating apparatus as set forth in claim 1 wherein said longitudinal portions include respective portions of the cup adjacent the longitudinal edges of the elongated opening.

4. X-ray generating apparatus as set forth in claim 3 wherein the electrical means includes means for varying the potential of the focusing cup independently of the other conductive members.

5. X-ray generating apparatus as set forth in claim 3 wherein said transverse portions comprise respective end tabs of the conductive strips, each tab being fixedly disposed in predetermined space relationship with the associated end of the filament and the opening of the cup.

6. X-ray generating apparatus as set forth in claim 5 wherein each of the tabs is positioned in spaced orthogonal relationship with the longitudinal edges of the elongated opening of the cup and substantially parallel overlying relationship with the associated end portion of the filament.

7. X-ray generating apparatus as set forth in claim 3 wherein the electrical means includes means for maintaining the tabs at a potential greater in magnitude than the potential of the focusing cup.

8. X-ray generating apparatus as set forth in claim 7 wherein the electrical means includes means for simultaneously varying the respective potentials of the tabs and for proportionately varying the potential of the focusing cup.

* * * * *

UNITED STATES PATENT OFFICE

CERTIFICATE OF CORRECTION

Patent No. 3,962,583 Dated June 8, 1976

Inventor(s) William P. Holland & Capleton I. Swanson

It is certified that error appears in the above-identified patent and that said Letters Patent are hereby corrected as shown below:

Col 5, line 17, change "86", first occurrence, to --84--.

Col 5, line 18, change "available" to --suitable--.

Col 5, line 28, change "circuit" to --conduit--.

Col 5, line 53, change "in" to --is--.

Col 6, line 16, change "arms" to --ears--.

Signed and Sealed this

Twenty-first Day of September 1976

[SEAL]

*Attest:*

RUTH C. MASON
*Attesting Officer*

C. MARSHALL DANN
*Commissioner of Patents and Trademarks*